US010328478B2

(12) United States Patent
Erlenmaier et al.

(10) Patent No.: US 10,328,478 B2
(45) Date of Patent: Jun. 25, 2019

(54) PUNCHING A WORKPIECE

(71) Applicant: TRUMPF Werkzeugmaschinen GmbH + Co. KG, Ditzingen (DE)

(72) Inventors: Werner Erlenmaier, Gerlingen (DE); Frank Schmauder, Metzingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 205 days.

(21) Appl. No.: 15/417,775

(22) Filed: Jan. 27, 2017

(65) Prior Publication Data

US 2017/0136519 A1 May 18, 2017

Related U.S. Application Data

(63) Continuation of application No. PCT/EP2015/066928, filed on Jul. 23, 2015.

(30) Foreign Application Priority Data

Jul. 28, 2014 (DE) ..... 10 2014 214 739

(51) Int. Cl.
*B21D 28/20* (2006.01)
*B30B 1/32* (2006.01)
(Continued)

(52) U.S. Cl.
CPC ..... *B21D 28/20* (2013.01); *B21D 28/002* (2013.01); *B30B 1/323* (2013.01); *B30B 15/161* (2013.01); *F15B 11/0325* (2013.01)

(58) Field of Classification Search
CPC ..... B21D 28/20; B21D 28/002; B30B 1/323; B30B 15/161; F15B 11/0325; F15B 7/04
See application file for complete search history.

(56) References Cited

U.S. PATENT DOCUMENTS 3,208,373 A * 9/1965 Bachelier ..... B21D 22/00 100/272
4,099,436 A 7/1978 Beneteau
(Continued)

FOREIGN PATENT DOCUMENTS

CN 1402656 3/2003
CN 101011866 8/2007
(Continued)

OTHER PUBLICATIONS

International Search Report from corresponding PCT Application No. PCT/EP2015/066928, dated Oct. 8, 2015, 4 pages.

*Primary Examiner* — Kenneth E Peterson
*Assistant Examiner* — Liang Dong
(74) *Attorney, Agent, or Firm* — Fish & Richardson P.C.

(57) ABSTRACT

This disclosure relates to methods and apparatuses for punching workpieces. A punching tool is configured to move during a punching stroke along a stroke axis towards a workpiece to be punched. The punching tool is configured to move away from the punched workpiece during a return stroke. The punching tool includes first and second components configured to be coupled hydraulically for concurrent movement along the stroke axis. The punching tool includes a punching drive for moving the first component along the stroke axis. The punching apparatus is configured to move the second component relative to the first component at a first transmission ratio during the punching stroke. The punching apparatus is configured to move the second component relative to the first component at a second transmission ratio in response to a reaction force of the workpiece exceeding a threshold value of the punching drive during the punching stroke.

23 Claims, 6 Drawing Sheets

(51) Int. Cl.

| | |
|---|---|
| ***B30B 15/16*** | (2006.01) |
| ***B21D 28/00*** | (2006.01) |
| *F15B 11/032* | (2006.01) |

(56) References Cited

U.S. PATENT DOCUMENTS

| | | | | |
|---|---|---|---|---|
| 4,395,027 | A * | 7/1983 | Nordmeyer | F15B 11/0325 269/25 |
| 5,345,766 | A | 9/1994 | Leonhartsberger et al. | |
| 6,874,343 | B1 | 4/2005 | Ariji | |
| 2004/0006984 | A1 * | 1/2004 | Sawdon | B21J 15/22 60/563 |
| 2009/0084277 | A1 | 4/2009 | Yanagimoto | |
| 2013/0055874 | A1 * | 3/2013 | Kerscher | B21D 5/0209 83/698.91 |

FOREIGN PATENT DOCUMENTS

| | | | |
|---|---|---|---|
| CN | 102161063 | | 8/2011 |
| EP | 0575343 | B1 | 5/1995 |
| EP | 1593444 | A1 | 11/2005 |
| EP | 1652660 | A1 | 5/2006 |
| JP | 2000141092 | A | 5/2000 |
| JP | 2006015392 | | 1/2006 |
| WO | WO2011079333 | A2 | 7/2011 |

* cited by examiner

PUNCHING A WORKPIECE

CROSS-REFERENCE TO RELATED APPLICATIONS

This application is a continuation of and claims priority under 35 U.S.C. § 120 to PCT Application No. PCT/EP2015/066928 filed on Jul. 23, 2015, which claims priority to German Application No. 10 2014 214 739.5, filed on Jul. 28, 2014. The entire contents of these priority applications are incorporated herein by reference.

TECHNICAL FIELD

The present invention relates to a punching apparatus and methods of punching workpieces with a punching tool of the punching apparatus

BACKGROUND

European Patent Publication EP 1 593 444 A1 discloses a punching apparatus that has a punching tool that is movable along a longitudinal axis. The punching apparatus has a drive device to move the punching tool in a linear, reciprocating movement that comprises a downward stroke and a return stroke. During the downward stroke of the punching apparatus engaged in punching the metal plate, the metal plate exerts a reaction force on the punching tool in a direction opposite of the direction of movement of the punching tool. The punching tool has a first component that is moved by the drive device with a predetermined first law of motion during the downward stroke and the return stroke. The punching tool also has a second component, which, during operation, cooperates with a ram to punch the metal plate. The second component is connected to the first component in a sliding manner and is positioned between the first component and the workpiece. Provided that the reaction force is below a predetermined value, the second component is moved axially substantially with the same law of motion as the first component during the downward stroke. The punching apparatus also has pressure-exerting means in order to move the second component with a second law of motion, different from the first, when the reaction force corresponds at least to the predetermined value.

The first component and the second component of the punching tool are moved concurrently by a drive device that comprise an electric motor acting on a threaded spindle. If the predetermined value of the reaction force is exceeded, the force of the electric motor is insufficient to punch through the workpiece. In this case, the pressure-exerting means are activated in order to enhance the force exerted on the workpiece and to punch through the workpiece. The first component is in this case moved toward the second component, which bears against the workpiece and is thus initially prevented from continuing to move downward. As a result of the relative movement between the first component and the second component, the hydraulic force on the second component is enhanced. If the first component is moved back upward after the workpiece has been punched through, the first component initially moves away from the second component along the stroke axis until the first component bears against a stop of the second component, such that it can entrain the second component upward during the return stroke.

European Patent Publication EP 0 575 343 B1 discloses an apparatus for carrying out a two-stage linear movement, in which a movable unit has a hydraulic piston with a cavity into which a plunger piston projects. The hydraulic piston bears a spindle that is rotatable by an electric motor, and the plunger piston is axially displaceable by means of the spindle in the hydraulic piston and a hydraulic cylinder, in order to build up pressure in the latter. The apparatus can have an auxiliary cylinder that is connected to the cylinder chamber of the hydraulic cylinder. Located in the auxiliary cylinder is a piston that is coupled to the hydraulic piston via a carrier plate and moves uniformly with said hydraulic piston.

US Patent Publication US 2009/0084277 discloses an apparatus that has a connecting mechanism for connecting an output shaft to an input shaft such that they are not movable relative to one another. To apply high pressure to the output shaft, a fluid pressure mechanism is provided, which is configured to establish a hydraulic connection between the output shaft and the input shaft in order to move them relative to one another. The connecting mechanism detects the contact of the output shaft with the workpiece and releases the connection between the output shaft and the input shaft. If, after the workpiece has been punched through, the input shaft is returned to a position prior to application of high pressure, the connection can be re-established automatically by the connecting mechanism. A similar apparatus, in which a through-bore extends in an axial direction from a second fluid chamber, which is formed between the output shaft and a fastening part, is disclosed in European Patent Publication EP 1 652 660 A1.

Japanese Patent Publication JP 2000-141092 discloses a punching machine that, in the case of a constant-power motor, is intended to allow both a movement with a low pressure force and a high speed prior to the punching operation and a movement with a high pressure force and a low speed during the punching of a workpiece. For this purpose, an oil chamber is formed in a housing and a first piston is provided, which is fastened at its front end to the rear end of a second piston. The first piston has a pressurizing surface and the second piston has at its rear end a pressure receiving surface, the area of which is greater than the area of the pressurizing surface.

PCT Patent Publication WO 2011/079333 A2 discloses a drive apparatus for a bending press, which comprises a stationary press beam and a press beam that is adjustable by means of a beam adjusting device having a hydraulic linear actuator. The linear actuator has a first piston arrangement having a first piston that subdivides a cylinder chamber into a first pressure chamber and a second pressure chamber. The linear actuator also has, in a further cylinder chamber, a further piston arrangement having a further piston and at least one further pressure chamber. The first piston arrangement and the second piston arrangement are coupled together.

SUMMARY

Various embodiments disclosed herein provide punching apparatuses and methods for punching a workpiece.

In one aspect, the disclosure provides punching apparatuses that include a punching tool configured to move during a punching stroke along a stroke axis (Z) toward a workpiece to be punched. The punching tool is configured to move away from the punched workpiece during a return stroke. The punching tool includes a first component and a second component configured to be coupled hydraulically for concurrent movement along the stroke axis (Z). The punching tool includes a punching drive for moving the first component along the stroke axis (Z). The punching apparatus is configured to move the second component relative to the first component at a first transmission ratio during the punching stroke. The punching apparatus is configured to move the second component relative to the first component at a second transmission ratio different than the first transmission ration in response to a reaction force (F) of the workpiece exceeding a threshold value of the punching drive during the punching stroke. The punching apparatus is configured to maintain a relative position of the first component with respect to the second component, taken up immediately after the workpiece has been punched through with a punching force greater than the threshold value, along at least a portion of the return stroke of the punching tool along the stroke axis. Within the meaning of this application, components are not necessarily understood to be one-piece components, rather each component can be assembled from several elements that are connected rigidly together.

In certain implementations, a punching drive, e.g., an electric punching drive, is used to move the first component along the stroke axis. To cover a range as large as possible of the punching force that is to be applied to the workpiece, the punching apparatus provides two force stages, of which the first force stage is implemented by the punching drive (optionally in combination with a fluid transmission) while the second force stage is implemented with a greater punching force by a greater transmission ratio between the first and the second components. The hydraulic coupling between the two components, which can be implemented as piston components, is realized in the punching apparatus by a closed hydraulic circuit, i.e. no hydraulic units (pumps etc.) for increasing the punching force or the transmission ratio are required.

To achieve a number of strokes that is as large as possible in such an energy-efficient punching apparatus, the disclosure proposes freezing the relative position that the two components take up with respect to one another immediately after the workpiece has been punched through, at least along a section of the return stroke along the stroke axis in various implementations. Accordingly, after the punching-through operation, the two components are moved away from the workpiece without a relative movement of the two components with respect to one another occurring. This applies both for operation of the punching apparatus at the first transmission ratio and for operation of the punching apparatus at the second transmission ratio.

The return stroke begins at the bottom dead center of the two components after the workpiece has been punched through. In certain embodiments, the section of the return stroke in which the relative position of the two components is frozen is selected to be so large that the punching die or the punching tool is withdrawn fully from the workpiece before the freezing of the relative position of the two components is canceled. As a result of the relative position of the two components being frozen, the punching tool can be moved away from the workpiece very quickly along this section. As a result, shortly after the punching-through operation, the workpiece can already be displaced laterally relative to the punching tool and can be positioned in a suitable manner for a subsequent punching stroke.

The freezing of the relative position can be canceled when the second component has taken up a defined position (reference position) along the stroke axis. Once the reference position has been reached, the second component can be clamped in place hydraulically (optionally with the additional assistance of a spring force), i.e., fixed in its reference position along the stroke axis. The first component is then displaced further along the stroke axis relative to the second component by the punching drive, until it reaches the top dead center of the reciprocating movement of the punching tool. Alternatively, it is also possible to carry out what is known as a flying reset. In the case of a flying reset, the second component is moved along the stroke axis, i.e., it is not necessary to carry out the reset at a resetting position of the second component.

The punching apparatus can be configured in particular to move the first and the second component at a first transmission ratio of 1:1, when the threshold value of the reaction force is not exceeded. The second transmission ratio between the first and the second component, i.e., the ratio between the distance traveled by the first component along the stroke axis and the distance simultaneously traveled by the second component along the stroke axis, is greater than the first transmission ratio in certain implementations, in order to achieve the increased force transmission, and can be, for example, more than 5:1, 8:1, etc.

If the first transmission ratio is 1:1 and the threshold value of the opposing force is not exceeded during the punching stroke, no change in the relative position of the two components takes place, and so they are moved back to the top dead center with the same relative position with respect to one another during the return stroke, without a reset being necessary. In this case, after the return stroke of the punching tool, a new punching stroke can immediately be carried out. If a relative movement between the two components has taken place during the punching stroke, i.e., if the threshold value of the opposing force was exceeded, it is necessary, in order to carry out a further punching stroke, for the two components to again take up the relative position that they took up before switching to the second transmission ratio, as was described in more detail above.

In various implementations, a cavity is formed in the second component, and a portion, forming a piston, of the first component projects into the cavity. Thus, the cavity can form a hydraulic cylinder in which that portion of the first component that forms the piston is guided so as to be displaceable in a linear manner. Within the meaning of this application, a portion that forms a piston is also understood to be an end of a piston rod, the end face of which forms an effective piston surface. In this case, the outer diameter of the piston rod is slightly smaller than the inner diameter of the cavity. A shoulder, against which the piston bears during operation at the first transmission ratio, can be formed in the cavity. If operation switches into the second transmission ratio, the piston is raised from the shoulder. If, in this case, the cavity is fluidically connected to a hydraulic cylinder in which the second component is guided, the second transmission ratio can be realized in this way. In addition, the shoulder can serve to support the piston during a return stroke, in order to entrain the second component during the return stroke movement, provided that the hydraulic coupling does not allow this on account of an error.

In particular implementations, the first component has a first piston that is guided in a first hydraulic cylinder so as to be displaceable in the stroke direction. As a result of the movement of the first component and thus of the piston in the first hydraulic cylinder, on account of a hydraulic coupling to a second hydraulic cylinder, force transmission to the second component can take place, such that the latter is moved along the stroke axis together with the first component, without a separate drive being necessary for this purpose. As is described further below, it is not absolutely necessary for the first component to have a piston guided in a hydraulic cylinder, however.

In certain implementations, the second component has a second piston that is guided in a second hydraulic cylinder so as to be displaceable in the stroke direction. As a result of a suitable hydraulic coupling of the second hydraulic cylinder to the first component, i.e., to the first hydraulic cylinder, in which the piston of the first component is guided in a displaceable manner, hydraulic force transmission between the two components can easily be realized.

In various implementations, during operation of the punching apparatus at the first transmission ratio, an effective piston surface of the first component matches an effective piston surface of the second component. In the case of the hydraulic coupling of the first and second hydraulic cylinders, when there are identical effective piston surfaces of the first and the second piston, a first transmission ratio of 1:1 can be realized. If appropriate, the first and/or the second component have, in addition to the effective piston surfaces formed on the first and second pistons, yet further effective piston surfaces, for example on further pistons that are guided in a displaceable manner in further hydraulic cylinders. The piston surfaces of these further pistons also contribute to the effective piston surface of the two components.

In particular implementations, the first hydraulic cylinder and the second hydraulic cylinder are configured as synchronized cylinders both during operation of the punching apparatus at the first transmission ratio and during operation at the second transmission ratio. In a synchronized cylinder, the two opposite sides of the effective piston surfaces have the same size, such that the piston is moved toward and away from the workpiece at the same speed. It has been found to be particularly advantageous for both hydraulic cylinders to be configured as synchronized cylinders, since in this case it is possible to completely dispense with the provision of a reservoir for pressure fluid (tank) as a compensating store, and to dispense with feeder valves. In certain implementations, the unpressurized side of the piston surface is connected to a compensating store with a very small volume during the punching operation. The compensating store serves to compensate the compression and temperature compensating volume. To configure the two hydraulic cylinders as synchronized cylinders in both transmission ratios, the effective piston surfaces of the two components are matched to one another or the two hydraulic cylinders are matched to one another. During such matching, further effective piston surfaces that may be present, for example in an auxiliary cylinder (see below), should also be taken into consideration.

In certain implementations, the first component has a cavity into which a positionally fixed piston of the first hydraulic cylinder projects. By way of the piston, the stroke length of the first hydraulic cylinder can be reduced. This is advantageous in particular in embodiments described herein in which synchronized cylinders are used, since synchronized cylinders generally have an increased space requirement for structural reasons.

In various implementations, the second hydraulic cylinder includes an auxiliary cylinder into which a further piston of the second component projects. The further piston, which is rigidly fastened to the second component for example via a common carrier plate, moves uniformly with the second piston of the second component along the stroke axis. The auxiliary cylinder is attached next to and parallel to the main cylinder of the second hydraulic cylinder, such that the stroke length of the second hydraulic cylinder is reduced thereby, this being favorable in particular when the second hydraulic cylinder is configured as a synchronized cylinder.

In particular implementations, the second component bears a punching die of the punching apparatus, or the second component acts itself as a ram. In this case, the second component, i.e., the punching die of the second component, comes into contact with the workpiece in order to punch through the latter during the punching stroke. The punching apparatus can have a measuring device, for example in the form of an optical or mechanical sensor, in order to detect and optionally regulate the position of the punching die or of the second component along the stroke axis, or to detect for example a resetting position at which the reset is intended to take place.

In certain implementations, the first component has a cavity in which a piston of a ram of the punching apparatus is guided so as to be displaceable in the stroke direction. In this case, it is not the second component that serves as a ram, rather, a cavity is likewise formed in the second component, through which the ram is guided in the axial direction to punch through the workpiece with its end remote from the first component.

In this case, the ram can include a second piston that is guided so as to be displaceable in a linear manner in the cavity, serving as a hydraulic cylinder of the second component. A punching apparatus having such a design has been found to be advantageous in particular in the realization of the flying reset described further above, since in this case the reset can take place directly through a hydraulic coupling between two pressure chambers surrounding the piston of the ram of the first component.

In various implementations, the punching apparatus comprises at least one hydraulic switching valve for switching between a movement of the two components at the first transmission ratio and a movement of the two components at the second transmission ratio, when the threshold value of the reaction force of the workpiece on the punching tool is exceeded. The switching valve can switch between two switched states in which different fluid paths for the hydraulic fluid (e.g., a hydraulic oil) are blocked and/or are released. The switching from the first switched state into the second switched state (and vice versa) can take place with the aid of a control device of the punching apparatus, which is communicably coupled to a sensor device that measures the reaction force that the workpiece exerts on the punching tool.

The switching from the second switched state into the first switched state of the switching valve takes place when the reaction force drops below the threshold value again. The switching valve can optionally be activated deliberately by a control device, i.e., be switched from the first switched state into the second switched state even when the reaction force is below the threshold value. This may be necessary to cause a reset during the return stroke, i.e., to allow a relative movement between the two components, for example by the second component being fixed in its position along the stroke axis.

In certain implementations, the switching valve has a hydraulic control line that is connected to a pressure-side pressure chamber of the punching tool to switch between the movement of the two components at the first transmission ratio and the movement of the two components at the second transmission ratio in the event that the threshold value of the reaction force is exceeded. A pressure-side pressure chamber of the punching tool is understood to be a pressure chamber that is bounded by a piston surface of one of the two components that is arranged on that side of the component that is remote from the workpiece. In such a pressure chamber, the pressure rises when the reaction force of the workpiece on the punching tool increases. The switching valve and the control line are configured such that the switching valve switches automatically when a pressure threshold in the pressure-side pressure chamber is exceeded, where the pressure threshold corresponds to the desired threshold value of the reaction pressure of the workpiece. If the pressure threshold is dropped below, the switching valve automatically switches back into the first switched state. Optionally, in the event that the pressure threshold is dropped below, the switching valve can be switched from the first switched state into the second by means of an additional control line.

In particular implementations, the punching apparatus comprises a resetting device having at least one hydraulic reset valve for changing the relative position of the two components during or after the return stroke along the stroke axis. The reset valve can be activated regardless of the reaction pressure of the workpiece with the aid of a control device. In principle, the control device can activate the reset valve at any desired position of the punching tool during the return stroke along the stroke axis, in order to change the relative position of the two components or in order to re-establish the original relative position of the two components at the beginning of the punching stroke. Generally, before the reset valve is activated, the movement of the second component along the stroke axis should be stopped, i.e., the second component should be in a resetting position and not move during the activation of the reset valve.

In order to effect the reset, the reset valve acts on the hydraulic circuit of the punching apparatus in a suitable manner, wherein a plurality of possibilities exist for such an action, as described further below. As has already been mentioned further above, it may be necessary to activate a further hydraulic valve to effect the reset. The further valve can be in particular the switching valve, which is activated by the control device simultaneously with the reset valve and thus itself serves as a reset valve.

In certain implementations, the reset valve is configured as a control valve. If the reset is carried out not in a fixed resetting position of the second component, but during the movement of the second component along the stroke axis, a difference between the speeds at which the first and the second component are moved occurs during the reset. Therefore, in this case, it is favorable, or even necessary, to configure the reset valve as a control valve. A control valve can not only be switched between two switched positions, but rather the throughflow through the control valve can be controlled or regulated by a control device at least in one of the switched positions. The throughflow can be regulated such that the reset is concluded when the two components take up a predetermined relative position with respect to one another, which can correspond to the relative position prior to switching from the first transmission ratio into the second. The use of a control valve has been found to be favorable in particular in embodiments described further above in which the first component has a cavity in which a ram of the punching apparatus is guided in a displaceable manner.

In various implementations, the reset valve is configured to hydraulically isolate at least one pressure chamber of the second hydraulic cylinder, i.e., to block a fluidic connection to the pressure chamber of the second hydraulic cylinder, to change the positioning of the two components relative to one another, i.e., in the active switched position. In a further pressure chamber of the second hydraulic cylinder, springs can be fitted, which push the second component against the isolated pressure chamber of the second hydraulic cylinder. In this way, the second component is fixed in its position along the stroke axis in the second hydraulic cylinder, while the first component is displaced relative to the second component during the reset. As an alternative to fixing the second component in the second hydraulic cylinder with the aid of compression springs, the second component can be clamped in place in the second hydraulic cylinder or fixed therein by the other pressure chamber of the second hydraulic cylinder likewise being hydraulically isolated.

In particular implementations, the switching valve is configured to establish a hydraulic connection between a pressure chamber of the first hydraulic cylinder and a reservoir for a hydraulic fluid in the event that the threshold value of the reaction force is exceeded. In this case, in the switched position of the switching valve in which the second transmission ratio exists, a part of the hydraulic fluid is delivered from the pressure chamber of the first hydraulic cylinder into the reservoir (e.g., a high-pressure tank). In a first switched position, the switching valve can serve to establish a fluidic connection between a pressure chamber of the first hydraulic cylinder and a pressure chamber of the second hydraulic cylinder, said fluidic connection being broken upon switching. In the non-active switched position of the reset valve, the latter can connect a further pressure chamber of the first hydraulic cylinder to a pressure chamber of the second hydraulic cylinder. If the reset valve is activated and this connection is interrupted, the pressure chamber of the second hydraulic cylinder is closed off, or hydraulically isolated.

In certain implementations, the switching valve is configured to establish a hydraulic connection between a first and a second pressure chamber of the first hydraulic cylinder in the event that the threshold value of the reaction force is exceeded. In this case, in the switched position of the switching valve in which the second transmission ratio exists, a part of the hydraulic fluid is delivered from a first pressure chamber of the first hydraulic cylinder into a second pressure chamber of the first hydraulic cylinder. In this way, the provision of a pressure tank or of a pressure reservoir can be avoided. These embodiments can be realized in particular when both hydraulic cylinders are configured as synchronized cylinders in both transmission ratios.

In particular implementations, the switching valve is configured to break a hydraulic connection between a first and a second pressure chamber of the second hydraulic cylinder in the event that the threshold value of the reaction force is exceeded, i.e., to hydraulically isolate the two pressure chambers of the second hydraulic cylinder. In this way, the second component guided in the second hydraulic cylinder is clamped in place, or fixed during the movement in the stroke direction. In such embodiments, a ram guided in the second component can serve to punch through the workpiece. In the first switched state of the switching valve, the first and the second pressure chamber of the second hydraulic cylinder can be connected together hydraulically.

In various implementations, the reset valve is configured to establish a hydraulic connection between a first pressure chamber and a second pressure chamber of the cavity formed in the first component in order to change the positioning of the two components relative to one another. In such embodiments, the reset valve is preferably configured as a control valve to change the relative position between a ram guided in the cavity of the first component and the first component along the stroke axis. In the first switched state of the reset valve, the latter can break the connection between the first pressure chamber and the second pressure chamber of the cavity in the first component, or hydraulically isolates the two pressure chambers, such that the ram is clamped in place or fixed in the first component and can be displaced together with the first component along the stroke axis without its relative position with respect to the first component being changed.

In a further embodiment, the punching apparatus additionally comprises a control device for controlling the punching drive and for controlling at least one reset valve of the resetting device. As was described further above, the activation of the at least one reset valve of the resetting device in order to change the relative position of the two components with respect to one another can take place either in a resetting position in which the first component (and thus the second component) is not displaced, or the reset can take place in a flying manner, i.e., while the two components are being displaced along the stroke axis. In both cases, coordination between the punching drive and the activation or deactivation of the at least one reset valve is necessary, this being undertaken by the control device. The control device can optionally also serve to regulate the punching stroke or the movement of the punching tool. In this case, the control device is connected to one or more sensors that measure the position of the first component, the second component and/or the ram along the stroke axis and optionally the reaction force exerted by the workpiece on the punching tool.

Certain embodiments provide methods for punching a workpiece. The methods include moving a punching tool comprising a first component and a second component configured to be coupled hydraulically in a punching stroke along a stroke axis (Z) toward a workpiece to be punched. Moving the punching tool includes moving the second component with respect to the first component at a first transmission ratio during the punching stroke. Moving the punching tool includes moving the second component with respect to the first component at a second transmission ratio different than the first transmission ratio, in response to the workpiece transferring a reaction force (F) that exceeds a threshold value to the punching tool during the punching stroke. The methods include punching through the workpiece by the punching tool. The methods can include moving the punching tool away from the punched workpiece during a return stroke along the stroke axis (Z). The punching apparatus maintains a relative position ($\Delta P'$) of the first component with respect to the second component taken up immediately after the workpiece has been punched through with a punching force greater than the threshold value. The relative position ($\Delta P'$) is maintained at least along a portion of the return stroke of the punching tool.

In certain implementations, a transmission ratio of 1:1 in particular can be selected as the first transmission ratio. The methods can include implementation via the embodiments described herein in conjunction with the punching apparatus as advantageous variants.

In various implementations, the methods include changing the relative position of the two components with respect to one another during the return stroke along the stroke axis in order to re-establish a relative position that the two components took up with respect to one another before the threshold value of the reaction force was exceeded. As was described above, the re-establishment of the relative position to move the two components into a relative position along the stroke axis, which they took up relative to one another before switching from the first transmission ratio into the second permits a new punching stroke to be carried out.

Certain implementations relate to computer program products, such as a non-transitory computer-readable storage device storing computer executable instructions, which if executed are configured to execute all of the steps of the above-described methods when the computer program is running on a data processing system.

Further advantages of the invention can be gathered from the description and the drawing. Likewise, the abovementioned features and those that are set out below can each be implemented individually or jointly in any desired combinations. The embodiments that are shown and described should not be understood as being a definitive list but rather as examples for outlining the invention.

DETAILED DESCRIPTION

In the following description, identical reference numbers and letters are used for identical or functionally identical components.

Figure 1:
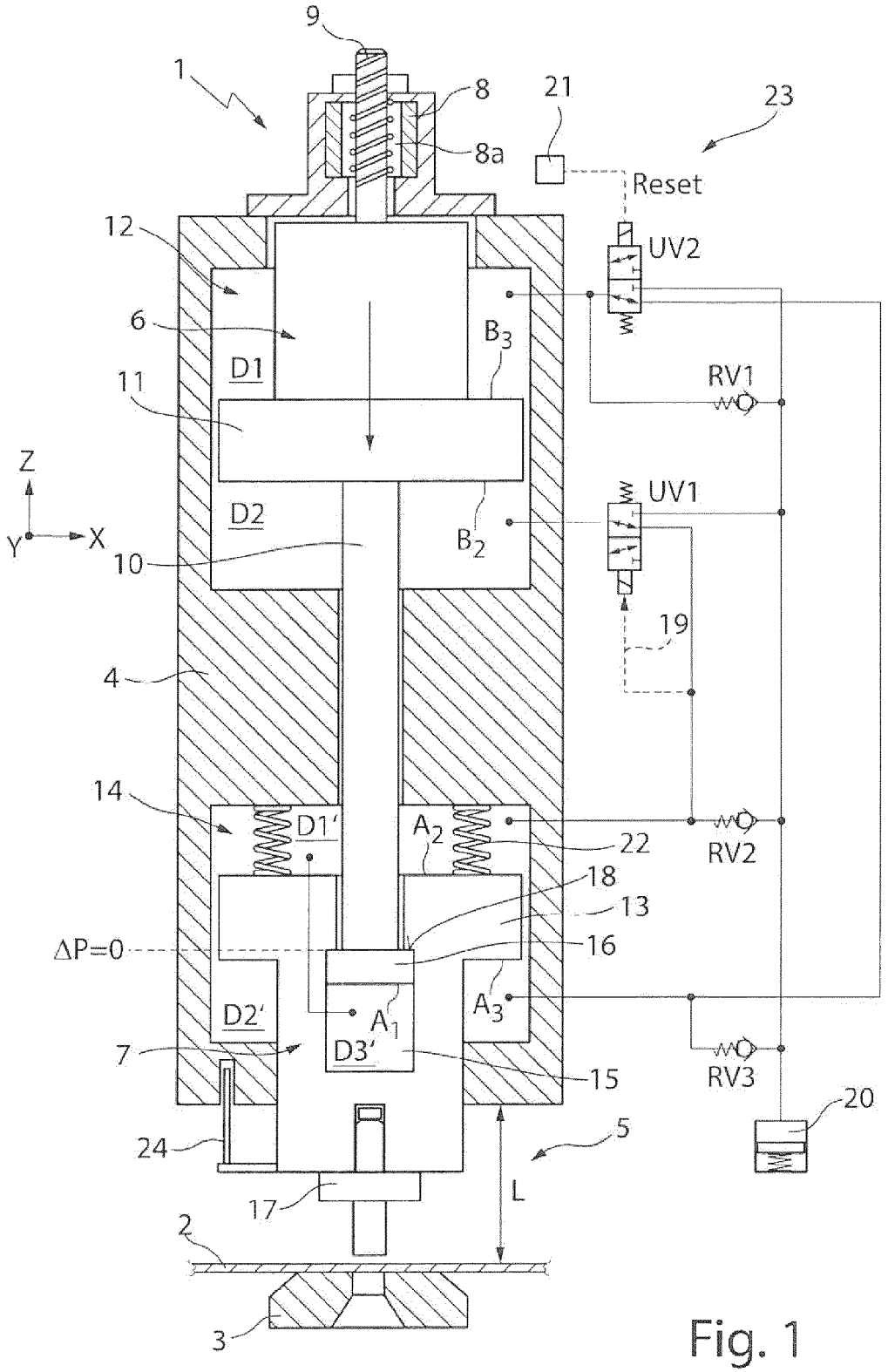
FIG. 1 shows a schematic illustration of an exemplary embodiment of a punching apparatus having a punching tool with two components that are movable relative to one another along a stroke axis at the beginning of a punching stroke.

FIG. 1 shows an example of a structure of a punching apparatus 1 for punching a plate-shaped workpiece 2 that is arranged in a supporting plane (XY plane) on a die 3, which is arranged at a predetermined spacing L from a housing 4 of the upper part of the punching apparatus 1. Both the die 3 and the housing 4 are positionally fixed in the example shown here, i.e. they do not move along a stroke axis (Z direction) perpendicular to the supporting plane. This is not the case for a punching tool 5, likewise shown in FIG. 1, which, like all parts of the punching apparatus 1 that are movable along the stroke axis Z, is illustrated without hatching to distinguish it from the positionally fixed components.

The punching tool 5 that is movable or displaceable along the stroke axis Z comprises a first component 6 and a second component 7, the relative position $\Delta P$ of which along the stroke axis Z can be changed, as is described in more detail further below. The first component 6 is coupled to a punching drive 8 that is configured as an electric drive for example in the form of a torque motor that acts on a threaded nut **8*a*** that sets a ball screw 9 formed on the first component 6 into rotation in order to displace the first component 6 along the stroke axis Z.

The first component 6 of the punching apparatus 1 has a piston rod 10 on which a first, upper piston 11 is formed, which is guided so as to be displaceable in the stroke direction Z in a first, upper hydraulic cylinder 12. In a corresponding manner, the second component 7 also has a piston 13, which is guided so as to be displaceable in a second, lower hydraulic cylinder 14 formed in the housing 4. The second component 7 includes a cavity 15, into which an end portion, forming a further, lower piston 16, of the piston rod 10 of the first component 6 projects. As is likewise discernible in FIG. 1, a punching die 17 is attached to the lower end, facing the workpiece 2, of the second component 7. The punching die 17 is moved so as to abut the workpiece 2 during the punching operation.

FIG. 1 shows the punching tool 5 at the beginning of the punching operation, i.e. at the top dead center of a reciprocating movement, which the punching tool 5 executes in a punching stroke toward the workpiece 2 and in a return stroke, after the punching-through operation, positioned away from the workpiece 2. In the starting position shown in FIG. 1, the two components 6, 7 take up a relative position ΔP with respect to one another along the stroke axis Z, in which the top side of the lower piston 16 of the first component 6 bears against an axial shoulder 18 of the cavity 15 in the second component 7. This relative position ΔP is (arbitrarily) set as the zero position, i.e., ΔP=0 in the starting position shown in FIG. 1.

Starting from the starting position shown in FIG. 1, the punching tool 5 is moved toward the workpiece 2 in that the punching drive 8 moves the first component 6 downward along the stroke axis Z. A first, upper pressure chamber D1 of the first hydraulic cylinder 12 is hydraulically coupled to a second, lower pressure chamber D2' of the second hydraulic cylinder 14 via a second switching valve UV2 that is located in a first switched position and serves as a reset valve. In a corresponding manner, a second, lower pressure chamber D2 of the first hydraulic cylinder 12 is hydraulically coupled to a first, upper pressure chamber D1' of the second hydraulic cylinder 14 via a first switching valve UV1 that is located in a first switched position. The first pressure chamber D1' of the second hydraulic cylinder 14 is permanently hydraulically connected to a third pressure chamber D3', located in the cavity 15 of the second component 7, of the second hydraulic cylinder 14.

The piston surface B3 on the top side of the first piston 11 of the first component 6 is the same size as the piston surface A3 on the underside of the piston 13 of the second component 7. In a corresponding manner, the piston surface B2 on the underside of the first piston 11 of the first component 6 is also the same size as the piston surface A2 on the top side of the piston 13 of the second component 7. In the starting position shown in FIG. 1, in which the lower piston 16 of the first component 6 bears against the shoulder 18 of the second component 7, the piston surface A3 on the underside of the lower piston 16 of the second component 7 plays no active part in punching. The effective piston surface B3-B2 of the upper piston 11 of the first component 6 and the effective piston surface A3-A2 of the piston 13 of the second component 7 are thus the same size. As a result, the two components 6, 7 are displaced along the stroke axis Z at a transmission ratio of 1:1, i.e. the two components 6, 7 are moved toward the workpiece 2 during the punching stroke, without the relative position ΔP thereof along the stroke axis Z changing.

If a reaction force F, which the workpiece 2 exerts on the punching tool 5, does not rise above a predetermined threshold value, the drive force of the electric punching drive 8 is sufficient to punch through the workpiece 2. In this case, both the punching stroke and the return stroke of the punching tool 5 take place without the relative position of the two components 6, 7 changing, i.e., ΔP=0 is maintained throughout the reciprocating movement.

Figure 2:
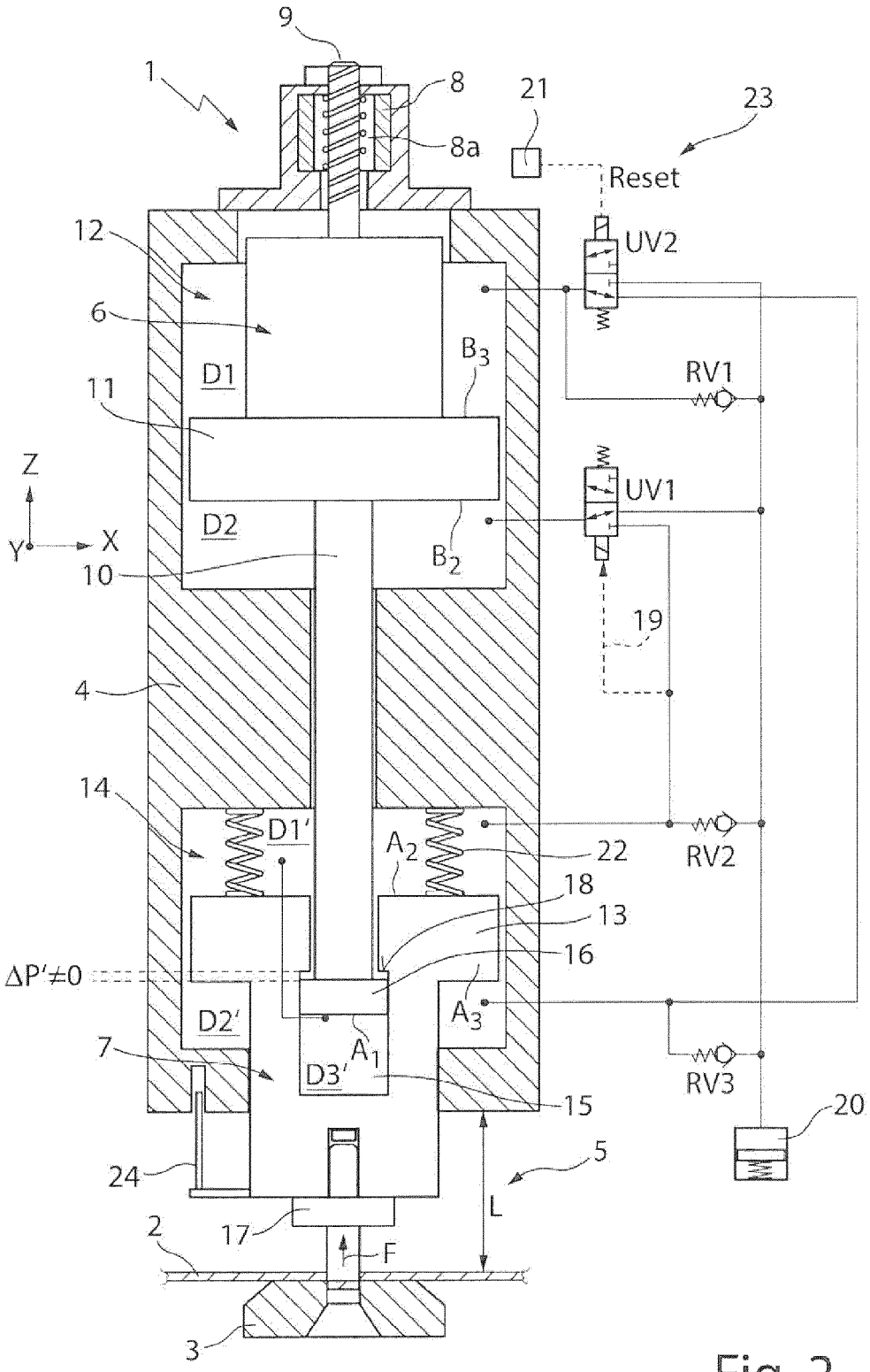
FIG. 2 shows an illustration similar to FIG. 1 with the punching tool at the bottom dead center of a punching stroke in which the two components take up a changed relative position with respect to one another.

If, during the punching operation, the reaction force F of the workpiece 2 and thus the pressure in the upper pressure chamber D1' of the second hydraulic cylinder 14 rises to such an extent that a pressurized control line 19 hydraulically connected to the upper pressure chamber D1' switches the first switching valve UV1 from the first switched state shown in FIG. 1 into a second switched state shown in FIG. 2, operation is switched between the first operating state with the first transmission ratio (1:1) between the first component 6 and the second component 7 and a second operating state with a second, greater transmission ratio (for example about 5:1 or more), as is explained in the following text with reference to FIG. 2.

In the second operating state (transmission operation), the first switching valve UV1 connects the second, lower pressure chamber D2 of the first hydraulic cylinder 12 to a reservoir 20 for the hydraulic fluid in the form of a high-pressure tank to which a pressure of for example about 10 bar is applied. The reservoir 20 is connected to the upper pressure chamber D1 of the first hydraulic cylinder 12 and to the upper and the lower pressure chamber D1', D2' of the second hydraulic cylinder 14 via three non-return valves RV1 to RV3. When the first component 6 moves toward the workpiece 2, the hydraulic fluid is delivered from the second pressure chamber D2 of the first hydraulic cylinder 12 into the reservoir 20 in transmission operation. At the same time, hydraulic fluid is delivered from the second pressure chamber D2' of the second hydraulic cylinder 14 into the upper pressure chamber D1 of the first hydraulic cylinder 12, since both are hydraulically connected in the second switched position of the first switching valve UV1. The lower piston 16 of the first component 6 is raised from the shoulder 18 of the second component 7 in transmission operation so as to result in a transmission ratio that is formed from the sum of the piston surface A2 of the piston 13 of the second component 7 and the piston surface A1 in the further pressure chamber D3' hydraulically connected to the upper pressure chamber D1' to the piston surface A1 of the piston 16 in the further pressure chamber D3', i.e., for the transmission ratio: A2/A1.

In the case of a circular piston surface A1 with a diameter of 35 cm and a circular piston surface A2 with a diameter of 100 cm, a transmission ratio of about 8:1 arises in transmission operation. The first component 6 thus travels eight times the distance traveled by the second component 7 along the stroke axis Z, with the result that the pressure that the second component 7 exerts on the workpiece increases in a corresponding manner. The hydraulic fluid that is missing from the upper pressure chamber D1 of the first hydraulic cylinder 12 on account of the different speeds of the two components 6, 7 in transmission operation is fed from the reservoir or from the tank 20 via the first non-return valve RV1.

FIG. 2 shows the punching tool 5 in transmission operation at the bottom dead center of the movement along the stroke axis, at which the workpiece 2 has been fully punched through. On account of the transmission ratio, different than 1:1, of 8:1 in transmission operation, the two components 6, 7 exhibit a relative position ΔP' different from zero immediately after punching through the workpiece 2, said relative position ΔP' depending on the distance traveled along the stroke axis Z at the second transmission ratio. Unlike the depiction in FIG. 2, the punching tool 5 can be displaced further downward after punching through the workpiece 2, until the bottom dead center of the movement is reached. Since, after the workpiece has been punched through, the further downward movement takes place at the transmission ratio of 1:1, the relative position ΔP' of the two components 6, 7 does not change in this case.

As is described below, the relative position ΔP' that the two components 6, 7 take up with respect to one another at the end of the downward movement is maintained at least along a section of the return stroke of the punching tool 5 into the starting position shown in FIG. 1, i.e., the relative position ΔP' is as it were "frozen" until a position referred to as the resetting position along the stroke axis Z is reached, at which the relative position ΔP' of the two components 6, 7 is transferred into the original relative position ΔP=0.

Since, after the workpiece 2 has been fully punched through, the reaction force F of the workpiece 2 and thus the pressure in the upper pressure chamber D1' of the second hydraulic piston 14 drops abruptly, the first switching valve UV1 is switched from the second switched state into the first switched state via the control line 19. Since the transmission ratio is 1:1 in the first switched position of the first switching valve UV1, during the movement of the first component 6 away from the workpiece 2 by means of the punching drive 8, the second component 7 is entrained without the relative position ΔP' changing. Thus, in the punching apparatus 1, it is not necessary to carry out a relative movement between the first component 6 and the second component 7 at the beginning of the return stroke in transmission operation. Such a movement would have the result that, for the movement of the second component 7 upward out of the workpiece 2, a comparatively large stroke movement of the first component 6 and thus a comparatively long duration would be necessary on account of the transmission ratio of 8:1. As a result of the movement of the punching tool 5 at least at the beginning of the return stroke in normal operation, the punching tool 5 and the second component 7 can be withdrawn quickly from the workpiece 2, such that, in the region of the supporting plane, the workpiece 2 can be quickly repositioned for a subsequent punching stroke. Since resetting into the original relative position ΔP also does not take place in transmission operation, the duration that is required overall for the return stroke is also considerably reduced.

Figure 3:
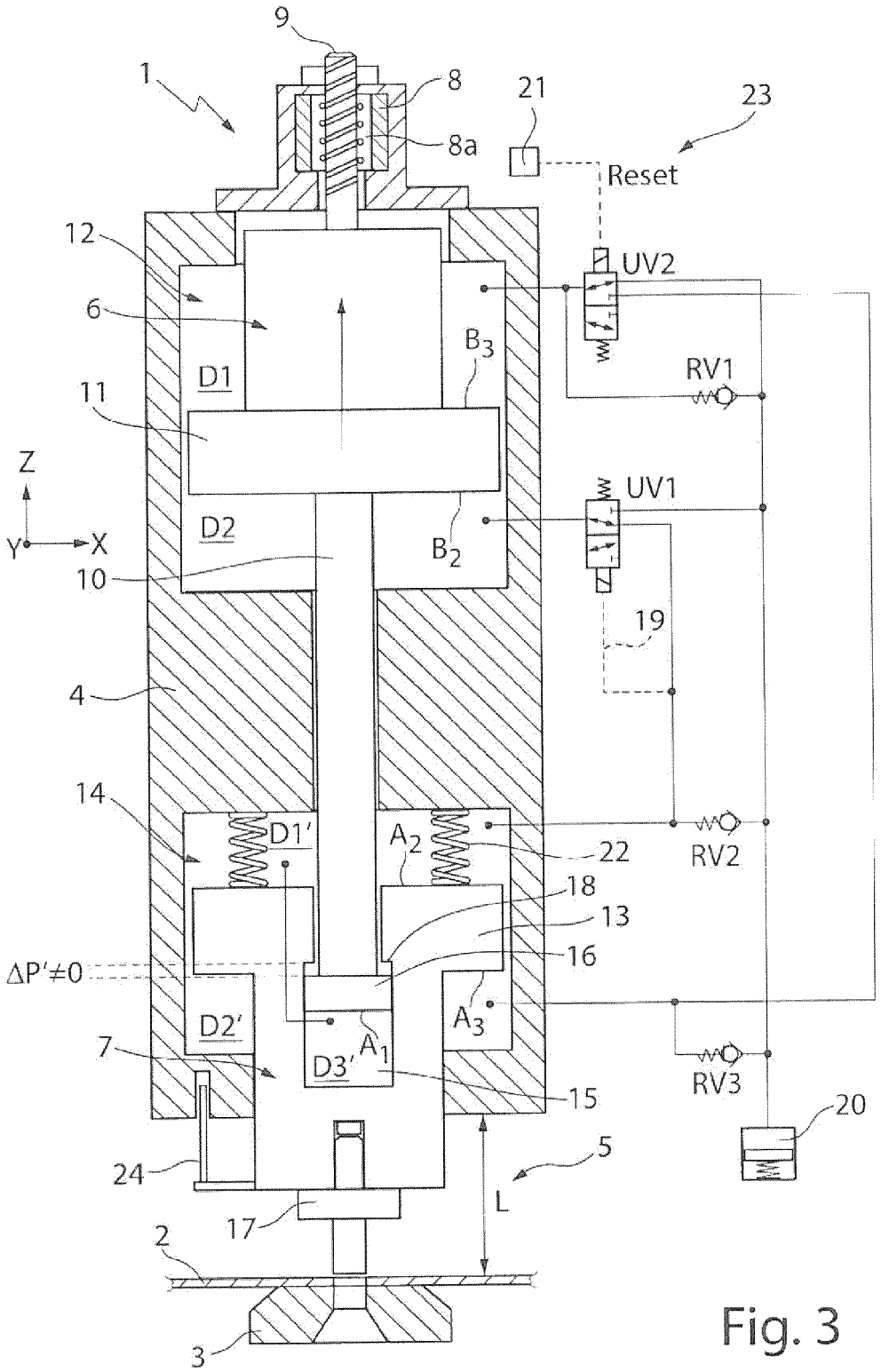
FIG. 3 shows an illustration similar to FIG. 1 and FIG. 2 with the punching tool in a resetting position in which the two components have been displaced along the stroke axis during a return stroke while maintaining their relative position.

In order to re-establish the original relative position ΔP of the two components 6, 7 with respect to one another, the punching tool 5 is moved into a resetting position shown in FIG. 3, which is located between the top dead center position shown in FIG. 1 and the bottom dead center position shown in FIG. 2 of the movement along the stroke axis Z. The resetting position should be selected such that at least that section of the return stroke that is required to withdraw the punching die 17 from the workpiece 2 has already been traveled along during the upward movement. If the reset is achieved, as in the example shown, in that the second component 7 is prevented from moving along the stroke axis Z, it can be favorable for the resetting position to be distant from the top dead center of the movement of the punching tool 5 at least by the amount of the relative position ΔP'.

To effect the reset, an electronic control device 21 of the punching apparatus 1 acts on the punching drive 8 to move the first component 6 and thus the punching tool 5 into the desired resetting position along the stroke axis Z. Once the desired resetting position has been reached, the control device 21 acts on the second switching valve UV2 to switch the latter from the first switched state into a second, in which the second switching valve UV2 serves as a reset valve. The control device 21 and the reset valve UV2 together form a resetting device 23 of the punching apparatus 1. The activation of the reset valve UV2 by the control device 21 can take place, for example, by way of a pneumatic control line illustrated by a dashed line. In the second switched position, shown in FIG. 3, of the reset valve UV2, the lower pressure chamber D2' of the second hydraulic cylinder 14 is hydraulically isolated. With the aid of compression springs 22 provided in the upper pressure chamber D1' of the second hydraulic cylinder 14, the second component 7 is fixed or clamped in place in the second hydraulic cylinder 14, such that it can no longer be displaced along the stroke axis Z in the second switched state of the reset valve UV2.

While the second component 7 is clamped in place in the stroke direction Z, the second component 7 is displaced further upward until the two components 6, 7 take up their original relative position ΔP=0 with respect to one another, in which the first and the second component 6, 7 bear against one another at the shoulder 18. During this resetting movement, the reset valve UV2 establishes a hydraulic connection between the upper pressure chamber D1 of the first hydraulic cylinder 12 and the reservoir 20 in order to deliver the hydraulic fluid passed into the reservoir 20 in transmission operation back into the upper pressure chamber D1. After the reset, the reset valve UV2 can be deactivated and the two components 6, 7 can be displaced along the stroke axis Z again at the top dead center (cf. FIG. 1) without any change in the relative position ΔP=0. The resetting position along the stroke axis Z can also be selected such that, after the first component 6 has been displaced so as to reach the original relative position ΔP=0, the starting position, shown in FIG. 1, of the punching tool 5 along the stroke axis Z is taken up.

To suitably control or regulate the punching tool 5 or the punching drive 8 by means of the control device 21, the punching apparatus 1 has, for example, an optical sensor 24 for determining the position of the second component 7 along the stroke axis Z. Further sensors for determining the position of the first component 6 and/or for determining the reaction force F that the workpiece 2 exerts on the punching tool 5 can be provided in the punching apparatus 1.

Figure 4:
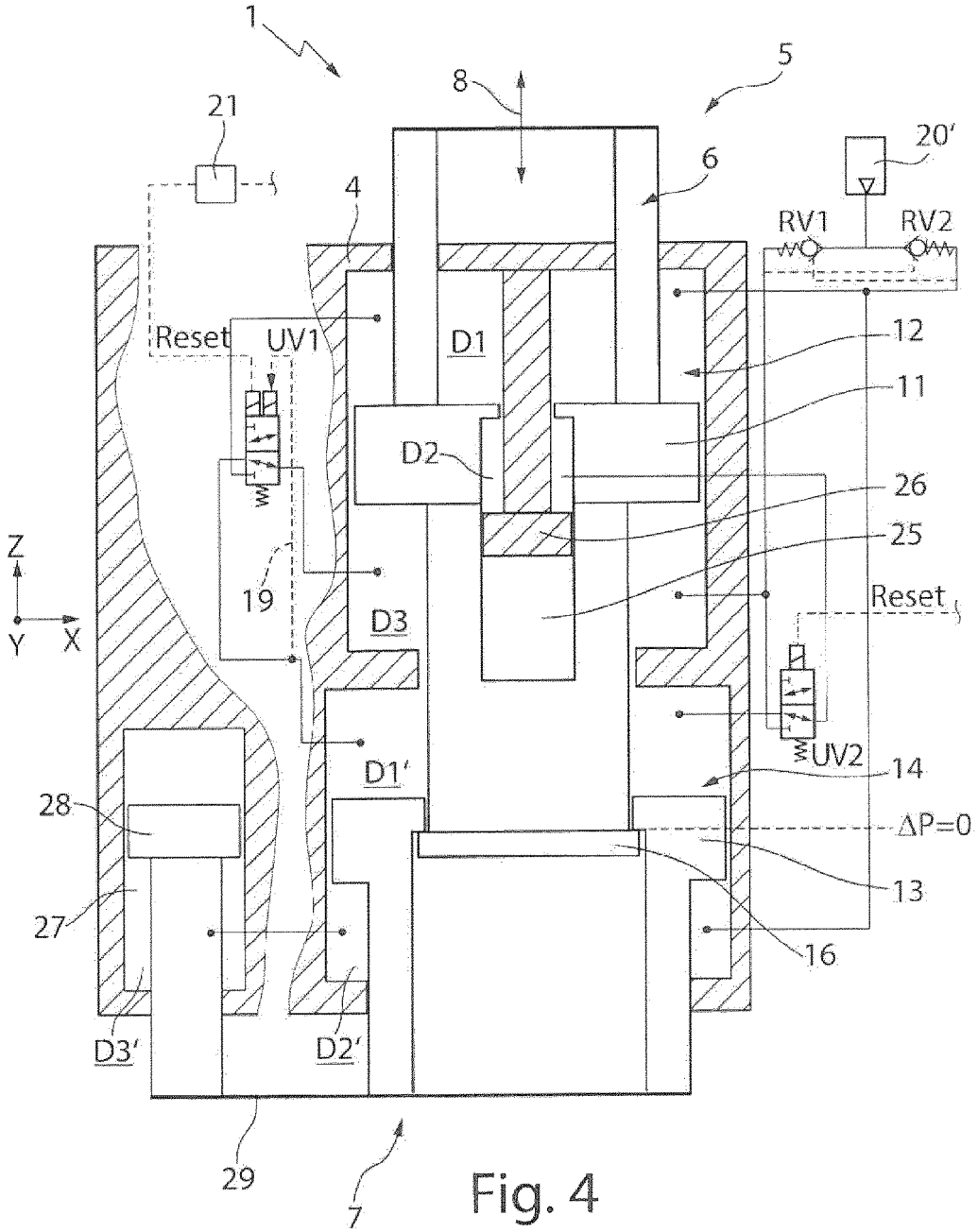
FIG. 4 shows an illustration of a further example of another embodiment of a punching apparatus in which the two components are guided so as to be displaceable in the stroke direction in two synchronized cylinders.

A further exemplary embodiment of a punching apparatus 1, which is shown in FIG. 4, is based on the basic principle described further above in conjunction with FIG. 1 to FIG. 3. In the punching apparatus 1 shown in FIG. 4, the upper component 6 is moved along the stroke axis Z via an electric punching drive 8 in the form of a linear drive and a hydraulic fluid transmission is realized with the aid of the further component 7. The major difference of the punching apparatus in FIG. 4 with respect to the punching apparatus 1 described further above is that, in the example shown in FIG. 4, both the first hydraulic cylinder 12 and the second hydraulic cylinder 14 are configured as synchronized cylinders, i.e. the piston surfaces that act against one another, or the corresponding surfaces of the pressure chambers, are the same size in each of the two hydraulic cylinders 12, 14, as is described below.

The first, upper hydraulic cylinder 12 has a first, upper pressure chamber D1. Formed in the first component 6 of the punching apparatus 1 in FIG. 4 is a cavity 25 into which a positionally fixed plunger piston 26 of the housing 4 projects and in which a second pressure chamber D2 is formed. The first hydraulic cylinder 12 also has a lower, third pressure chamber D3. The hydraulically effective surfaces of the pressure chambers D1 to D3 and the hydraulically effective surfaces of the piston 11 of the first component 6 are matched to one another such that the upper hydraulic cylinder 12 forms a synchronized cylinder.

The second, lower hydraulic cylinder 14 likewise has a first, upper pressure chamber D1' and a second, lower pressure chamber D2', between which a piston 13 of the second component 6 is guided in a displaceable manner. The second hydraulic cylinder 14 has an auxiliary cylinder 27 into which a further piston 28 of the second component 7 projects in order to reduce the overall height of the second hydraulic cylinder 14. The further piston 28 is rigidly connected to the piston 13, guided in parallel, of the second component 7 via a carrier plate 29. A punching die of the punching apparatus 1 can be attached to the carrier plate 29 in order to punch through a workpiece 2 (not depicted in FIG. 4). Additionally, formed in the auxiliary cylinder 27 is a third pressure chamber D3' that is permanently hydraulically connected to the second, lower pressure chamber D2' of the second hydraulic cylinder 14. The hydraulically effective surfaces of the pressure chambers D1', D2', D3' and the corresponding hydraulically effective surfaces of the piston 16 and of the further piston 28 are matched to one another such that the lower hydraulic cylinder 14 likewise forms a synchronized cylinder.

In normal operation, i.e. in the position, shown in FIG. 4, of the two switching valves UV1, UV2, both the third pressure chamber D3 and the second pressure chamber D2 of the upper hydraulic cylinder 12 are hydraulically connected to the upper pressure chamber D1' of the lower hydraulic cylinder 14. The hydraulically effective surfaces of the two pressure chambers D2, D3 (and the associated piston surfaces) of the upper hydraulic cylinder 12 are the same size as the hydraulically effective surface of the upper pressure chamber D1' of the lower hydraulic cylinder 14. The first, upper pressure chamber D1 of the first hydraulic cylinder 12 is permanently connected to the second, lower pressure chamber D2' (and thus also to the third pressure chamber D3') of the second hydraulic cylinder 14. The hydraulically effective surface of the upper pressure chamber D1 of the upper hydraulic cylinder 12 corresponds to the hydraulically effective surfaces of the second and third pressure chambers D2', D3' of the lower hydraulic cylinder 14. In this way, in normal operation, a transmission ratio of 1:1 is realized, i.e., in normal operation, the two components 6, 7 move in the relative position ΔP=0 shown in FIG. 4, in which the lower piston 16 of the first component 6 bears against a shoulder 18 of the second component 7, along the stroke axis Z.

In transmission operation, i.e. when a threshold value of the reaction force F that the workpiece 2 exerts on the punching tool 5 is exceeded, the pressure in the upper pressure chamber D1' of the lower hydraulic cylinder 14 increases and the first switching valve UV1 is activated via the control line 19 hydraulically connected thereto and switched from the first switched state into the second. In the second switched state, the first switching valve UV1 establishes a hydraulic connection between the first pressure chamber D1 and the third pressure chamber D3 of the upper hydraulic cylinder 12 and breaks the hydraulic connection between the third pressure chamber D3 of the upper hydraulic cylinder 12 and the first pressure chamber D1' of the lower hydraulic cylinder 14. The hydraulically effective surfaces of the first pressure chamber D1 and of the third pressure chamber D3 are opposed, such that the hydraulically effective surface of the second pressure chamber D2, which acts on the hydraulically effective surface of the first pressure chamber D1' of the second hydraulic cylinder 14, arises as the resulting hydraulically effective surface of the first hydraulic cylinder 12. On account of the different sizes of the hydraulically effective surfaces of the second pressure chamber D2 of the first hydraulic cylinder 12 and of the first pressure chamber D1' of the second hydraulic cylinder 14, a transmission ratio of D1'/D2, which can be for example about 5:1 or more, results in transmission operation.

After the workpiece 2 has been punched through, the pressure in the upper pressure chamber D1' of the second hydraulic cylinder 14 drops quickly and the first switching valve UV1 switches back into the first switched state. The punching tool 5 is retracted, in normal operation, i.e. at a transmission ratio of 1:1, along the stroke axis Z until a resetting position is reached. In the resetting position, as was described further above in conjunction with FIG. 1 to FIG. 3, the second component 7 is clamped in place in the second hydraulic cylinder 14, to displace the first component 6 relative to the second component 7 by the punching drive 8 and to re-establish the original relative position ΔP=0, shown in FIG. 4, of the two components 6, 7.

To allow this resetting movement, both the first switching valve UV1 and a second switching valve UV2 that serves as a reset valve are switched simultaneously from the first switched state into the second, in that the control device 21 acts on both switching valves UV1, UV2 by a respective pneumatic control line. As a result of the activation of both switching valves UV1, UV2, the upper pressure chamber D1' of the second hydraulic cylinder 14 is hydraulically isolated such that the second component 7 guided therein cannot be displaced further upward. At the same time, the second switching valve UV2 establishes a hydraulic connection between the first pressure chamber D1 and the third pressure chamber D3 of the upper hydraulic cylinder 12, i.e., the upper hydraulic cylinder is short-circuited.

If the two switching valves UV1, UV2 are not switched exactly synchronously, this does not have any negative effects on the punching apparatus 1, i.e., it does not result in stresses. The punching apparatus 1 shown in FIG. 4 additionally has the advantage that no pressure tank or the like for holding hydraulic fluid is required, since the two hydraulic cylinders 12, 14 are configured as synchronized cylinders and the hydraulically effective surfaces of the two hydraulic cylinders 12, 14 are matched to one another such that, even in transmission operation, i.e. at the second transmission ratio, synchronism is ensured. The matching of the hydraulically effective surfaces is realized in FIG. 4 in that, for the pressure chambers D1, D2, D3 of the upper hydraulic cylinder 12 and for the first pressure chamber D1' of the lower hydraulic cylinder 14, D1'=D2+D3. Moreover, in the example shown, D2'=D3'.

As can be seen in FIG. 4, only one reservoir 20' with a very small capacity is required, the reservoir 20' being connected via two non-return valves RV1, RV2 to the third pressure chamber D3 of the upper hydraulic cylinder 12 and to the second pressure chamber D2' of the lower hydraulic cylinder 14 (i.e., to the unpressurized side). The reservoir 20' serves as a compensating volume, i.e., as a temperature compensating volume and as a compression compensating volume. Overall, the punching apparatus 1 shown in FIG. 4 manages with a small number of component parts and can therefore be realized with a compact design. In addition, during surface switching, i.e., during switching between the first transmission ratio and the second transmission ratio, there is no jump in force but rather a continuous transition, such that the (closed) hydraulic circuit and in particular the switching valves UV1, UV2 are not excessively loaded. Additionally, in the embodiment shown in FIG. 4, no force transmission via the stop 18 is necessary during the return stroke, i.e., the shoulder 18 serves merely for safety and is not absolutely necessary for carrying out the punching stroke.

A further embodiment of the punching apparatus 1 is described in the following text with reference to FIG. 5 and FIG. 6. A major difference between the punching apparatus 1 described in FIG. 5 and FIG. 6 and the punching apparatuses 1 described further above is that a ram 30 is additionally provided, which serves to punch the workpiece 2 and that can be displaced relative to the first component 6 and the second component 7 along the stroke axis Z. The ram 30 has a piston rod 33 on which a first piston 31 and a second piston 32 are formed. The first piston 31 of the ram 30 is guided so as to be displaceable in the stroke direction Z in a cavity 25 of the first component 6. The second component 7, too, has a cavity 15 in which the second piston 32 of the ram 30 is guided so as to be displaceable in the stroke direction Z. On its outer side, the second component 7 additionally has a piston 13 that is guided so as to be displaceable in a second or only hydraulic cylinder 14 in the housing 4 of the punching apparatus 1. By contrast, the first component 6 is not guided so as to be displaceable in a hydraulic cylinder, but is driven directly by means of an electric punching drive 8 that can be configured for example as a linear drive, such that the first component 6 acts as a linear actuator.

Figure 5:
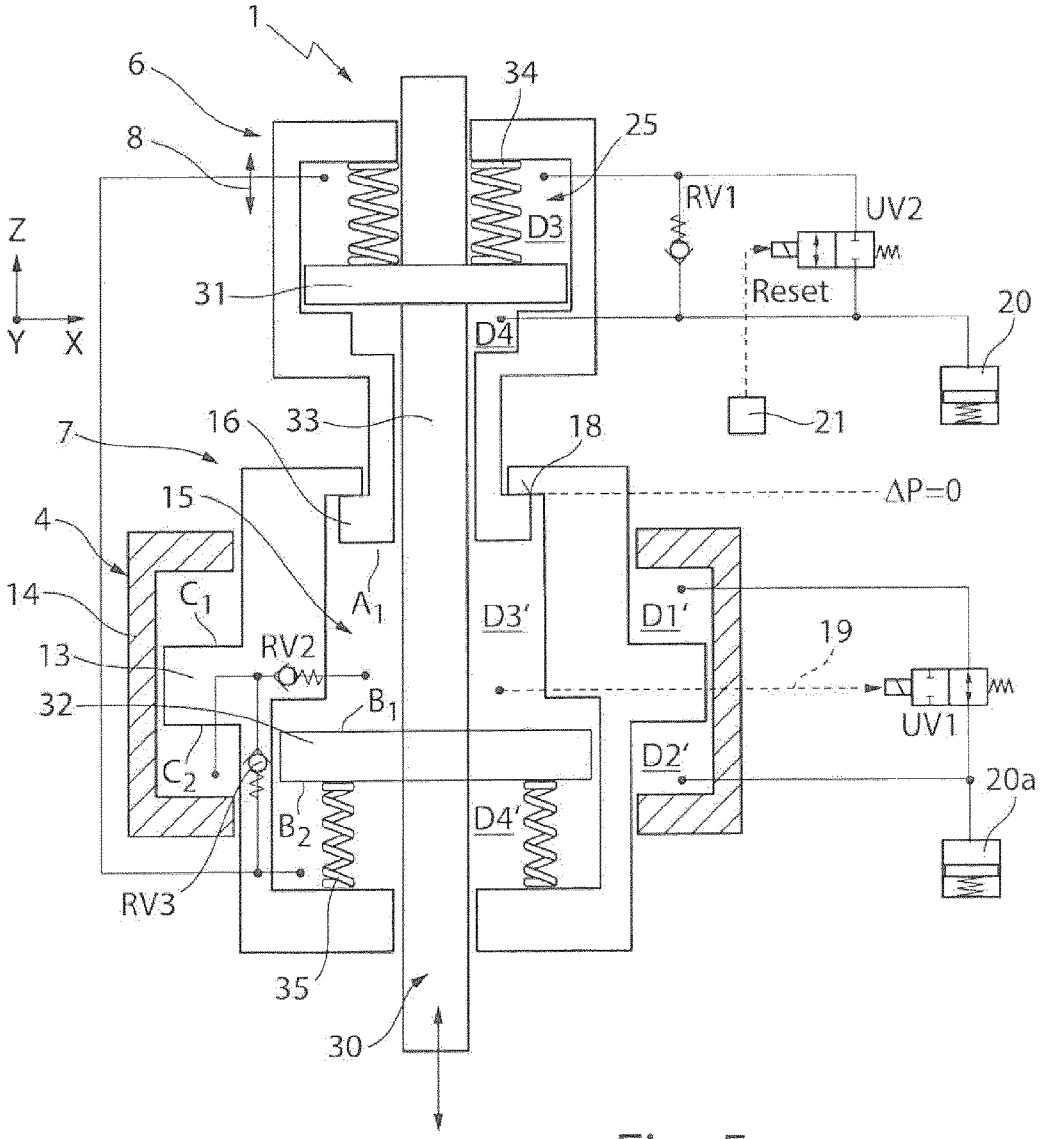
FIG. 5 shows an illustration of a further example of another embodiment of a punching apparatus having two components, in the cavities of which a piston rod of a ram is guided in a displaceable manner, during operation at a first transmission ratio.

In the position, shown in FIG. 5, of the two components 6, 7 relative to one another, the piston 16 of the first component 6 bears with its upper side against an axial stop 18 of the second component 7, i.e., the two components 6, 7 take up a relative position ΔP=0 with respect to one another. In normal operation, in which a first switching valve UV1 is in a first switched state, a hydraulic connection is established between an upper pressure chamber D1' and a lower pressure chamber D2' of the hydraulic cylinder 14. The piston 13 of the second component 7 or of the hydraulic cylinder 14 is configured as a synchronized cylinder, i.e. the upper and lower piston surfaces C1, C2 of the piston 13 are the same size. In normal operation, a first, upper pressure chamber D3 of the cavity 15 in the second component 7 is hydraulically separated by the second switching valve UV2 in a first switched state, i.e. the upper piston 31 of the ram 30 is clamped in place such that the ram 30 is displaced along the stroke axis Z in a conjoint or concurrent movement together with the first component 6 and the second component 7.

Figure 6:
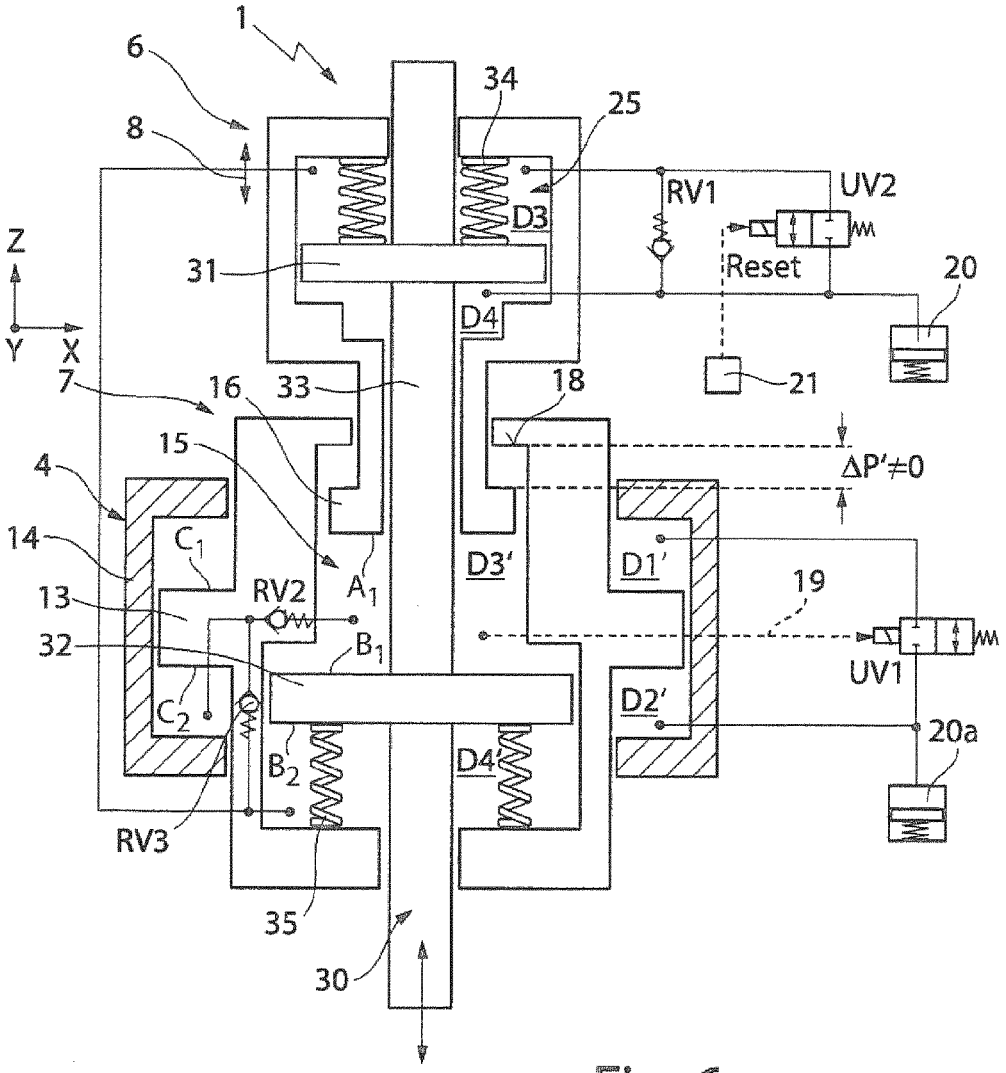
FIG. 6 shows an illustration of the punching apparatus of FIG. 5 during operation at a second transmission ratio different from the first.

FIG. 6 shows the punching apparatus 1 in transmission operation, in which the threshold value of the reaction force F of the workpiece 2 has been exceeded, such that the pressure in an upper pressure chamber D3' of the cavity 13 in the lower component 7 has risen to such an extent that the first switching valve UV1 has switched into the second switched position via the control line 19. In the second switched position, the upper pressure chamber D1' and the lower pressure chamber D2' of the hydraulic cylinder 14 are hydraulically separated such that the second component 7 is clamped in place in the hydraulic cylinder 14. The first component 6, acting as a linear actuator, is displaced further downward by means of the punching drive 8 in transmission operation until the workpiece has been fully punched through and the two components 6, 7 take up the position ΔP', shown in FIG. 6, relative to one another along the stroke axis Z. On account of the smaller effective piston surface A1 of the piston 16 of the first component 6 relative to the effective piston surface B1 on the top side of the lower piston 32 of the ram 30, a transmission ratio of B1/A1 is created in transmission operation. In this case, the fact that the lower pressure chamber D4' of the cavity 15 of the second component 15 is permanently hydraulically connected to an upper pressure chamber D3 of the cavity 25 of the upper component 6 is exploited.

During a return stroke, to displace the first component 6 relative to the second component 7 and in the process to create the relative position ΔP=0, shown in FIG. 5, of the two components 6, 7 again, the second switching valve UV2, serving as a reset valve, is switched into the second switched state during the return stroke, i.e. during the movement of the first component 6 along the stroke axis. In the second switched state, the second switching valve UV2 connects the upper pressure chamber D3 to the lower pressure chamber D4 of the cavity 25 of the first component 6.

The second switching valve UV2 is a control valve in which the flow rate in the second switched state can be set or regulated by means of the control device 21 depending on the resetting speed. In this way, during the movement of the first component 6 along the stroke axis Z, the relative movement between the ram 30 and the first component 6 can be directly influenced. Depending on the valve opening or on the throughflow through the second switching valve UV2 that serves as a reset valve, the return stroke or the relative movement between the ram 30 and the first component 6 and between the first component 6 and the second component 7 can be regulated, with the result that the dynamics during the return stroke can be substantially increased. The regulation can take place such that, at the end of the braking movement, the reset is complete.

The difference in volume between the hydraulic fluid, which passes into the respective pressure chambers D1', D2', D3, D4, D3', D4' on account of the different speeds of the ram 30 and of the first component 6 and of the second component 7, can be compensated by two reservoirs (pressure tanks) 20, 20*a*, into which the corresponding fluid volume is delivered or from which the required fluid volume of hydraulic fluid can be removed. For this purpose, and to compensate leakage losses of the hydraulic fluid, three non-return valves RV1 to RV3 are arranged in the punching apparatus 1.

To reset the ram 30 into the relative position ΔP=0 shown in FIG. 5, a first compression spring 34, which defines the zero position of the first component 6 relative to the first piston 31, is arranged in the upper pressure chamber D3 of the cavity 25 of the first component 6, and a second compression spring 35, which serves for resetting and that exerts on the upper pressure chamber D3' of the cavity 13 a force that increases the pressure in the upper pressure chamber D3', is arranged in the second, lower pressure chamber D4' of the second component 7. The second compression spring 35 thus influences the threshold value of the reaction force F at which switching takes place between the first transmission ratio and the second transmission ratio.

The exemplary embodiments, described further above, of the punching apparatus 1 can also be modified. For example, it is possible to dispense with the provision of a shoulder 18 on the second component 7, or a piston, which interacts with such a shoulder 18, at the lower end of the first component 6 is not absolutely necessary. In this case, the lower end face of the portion, configured as a piston rod, of the first component 6 can serve as a hydraulically effective surface, for example. Also, in the embodiment described in FIG. 1 to FIG. 3, the second component 6 can be clamped in place in the manner described in FIG. 5 and FIG. 6, i.e., in that the two compression chambers D1', D2' of the second hydraulic cylinder 14 are hydraulically isolated such that the piston 13 of the second component 7 is hydraulically clamped in place.

In summary, high dynamics can be achieved during the return stroke in the punching apparatuses 1 described further above, since in particular the beginning of the return stroke, i.e. the beginning of the movement from the bottom dead center, is not carried out at the second, greater transmission ratio, but with the relative position of the two components 6, 7 being maintained, respectively, at the first transmission ratio. In this way, a highly dynamic punching movement with two (or possibly more) force stages can be realized with a closed, energy-efficient hydraulic circuit.

OTHER EMBODIMENTS

A number of embodiments of the invention have been described. Nevertheless, it will be understood that various modifications may be made without departing from the spirit and scope of the invention. Accordingly, other embodiments are within the scope of the following claims.

What is claimed is:

1. A punching apparatus comprising:

a punching tool configured to move during a punching stroke along a stroke axis (Z) toward a workpiece to be punched, wherein the punching tool is configured to move away from the punched workpiece during a return stroke, and wherein the punching tool comprises a first component and a second component configured to be coupled hydraulically for concurrent movement along the stroke axis (Z); and a punching drive for moving the first component along the stroke axis (Z), wherein the punching apparatus is configured to move the second component relative to the first component at a first transmission ratio during the punching stroke, wherein the punching apparatus is configured to move the second component relative to the first component at a second transmission ratio different than the first transmission ratio in response to a reaction force (F) of the workpiece exceeding a threshold value of the punching drive during the punching stroke, and wherein the punching apparatus is configured to maintain a relative position (ΔP') of the first component with respect to the second component taken up after the workpiece has been punched through with a punching force greater than the threshold value along at least a portion of the return stroke of the punching tool along the stroke axis (Z).

2. The punching apparatus of claim 1, wherein the second component includes a cavity and an end portion of the first component is configured as a piston projecting into the cavity.

3. The punching apparatus of claim 1, further comprising a first hydraulic cylinder, wherein the first component comprises a first piston guided in the first hydraulic cylinder so as to be displaceable in the stroke direction (Z).

4. The punching apparatus of claim 3, wherein the second component comprises a second piston guided in a second hydraulic cylinder so as to be displaceable in the stroke direction (Z).

5. The punching apparatus of claim 4, wherein an effective piston surface of the first component matches an effective piston surface of the second component during operation of the punching apparatus at the first transmission ratio.

6. The punching apparatus of claim 4, wherein the first hydraulic cylinder and the second hydraulic cylinder are configured to act as synchronized cylinders during operation at the first transmission ratio and during operation at the second transmission ratio.

7. The punching apparatus of claim 3, further comprising a positionally fixed piston of the first hydraulic cylinder projecting into a cavity of the first component.

8. The punching apparatus of claim 4, further comprising an auxiliary cylinder in the second hydraulic cylinder and a further piston of the second component projecting into the auxiliary cylinder.

9. The punching apparatus of claim 1, wherein the second component comprises a punching die.

10. The punching apparatus of claim 1, further comprising a ram comprising a piston configured to be guided in a cavity of the first component so as to be displaceable in the stroke direction (Z).

11. The punching apparatus of claim 10, wherein the ram comprises a further piston configured to be guided in the cavity of the second component so as to be displaceable in the stroke direction (Z).

12. The punching apparatus of claim 1, further comprising:

at least one hydraulic switching valve for switching between movement of the second component with respect to the first component at the first transmission ratio and movement of the second component with respect to the first component at the second transmission ratio.

13. The punching apparatus of claim 12, wherein the switching valve comprises a control line connected to a pressure-side pressure chamber of the punching tool to switch between the movement of the second component with respect to the first component at the first transmission ratio and the movement of the second component with respect to the first component at the second transmission ratio in the event that the threshold value of the reaction force (F) is exceeded.

14. The punching apparatus of claim 1, further comprising:

a resetting device comprising at least one hydraulic reset valve for changing the relative position of the second component with respect to the first component during the return stroke along the stroke axis (Z).

15. The punching apparatus of claim 14, in which the at least one hydraulic reset valve is configured as a control valve.

16. The punching apparatus of claim 14, wherein the reset valve is configured to hydraulically isolate at least one pressure chamber of the second hydraulic cylinder to change the positioning of the second component with respect to the first component.

17. The punching apparatus of claim 12, wherein the switching valve is configured to establish a hydraulic connection between a pressure chamber of a first hydraulic cylinder configured to guide a first piston of the first component in the stroke direction (Z) and further comprising a reservoir for a hydraulic fluid used in the first hydraulic cylinder in the event that the threshold value of the reaction force (F) is exceeded.

18. The punching apparatus of claim 12, wherein the switching valve is configured to establish a hydraulic connection between a first and a second pressure chamber of a first hydraulic cylinder configured to guide a first piston of the first component in the stroke direction (Z) in the event that the threshold value of the reaction force (F) is exceeded.

19. The punching apparatus of claim 18, wherein the switching valve is configured to break a hydraulic connection between a first and a second pressure chamber of a second hydraulic cylinder configured to guide a second piston of the second component in the event that the threshold value of the reaction force (F) is exceeded.

20. The punching apparatus as claimed in claim 19, further comprising a resetting device comprising at least one hydraulic reset valve for changing the relative position of the second component with respect to the first component during the return stroke along the stroke axis (Z), wherein the hydraulic reset valve is configured to establish a hydraulic connection between a first pressure chamber and a second pressure chamber of a cavity formed by the first component to change the positioning of the second component with respect to the first component.

21. The punching apparatus of claim 1, further comprising:

a control device for controlling the punching drive and for controlling at least one reset valve of a resetting device comprising at least one hydraulic reset valve for changing the relative position of the second component with respect to the first component during the return stroke along the stroke axis (Z).

22. A method for punching a workpiece, the method comprising:

moving a punching tool comprising a first component and a second component configured to be coupled hydraulically in a punching stroke along a stroke axis (Z) toward a workpiece to be punched, wherein moving the punching tool comprises moving the second component with respect to the first component at a first transmission ratio during the punching stroke, and moving the second component with respect to the first component at a second transmission ratio, different than the first transmission ratio, in response to the workpiece transferring a reaction force (F) that exceeds a threshold value to the punching tool during the punching stroke;

punching through the workpiece by the punching tool; and moving the punching tool away from the punched workpiece during a return stroke along the stroke axis (Z), wherein the punching apparatus maintains a relative position (ΔP') of the first component with respect to the second component taken up after the workpiece has been punched through with a punching force greater than the threshold value and maintained at least along a portion of the return stroke of the punching tool.

23. The method as claimed in claim 22, further comprising: changing the relative position (ΔP') of the first component with respect to the second component during the return stroke along the stroke axis (Z) to re-establish a prior relative position (ΔP) of the first component with respect to the second component held before the threshold value of the reaction force (F) was exceeded.

* * * * *